US005950375A

United States Patent [19]

Zaccagni

[11] Patent Number: 5,950,375

[45] **Date of Patent: *Sep. 14, 1999**

[54] COMBINED FASCIA AND SOFFIT MEMBER ROLL-FORMED FROM SHEET METAL

[75] Inventor: Richard J. Zaccagni, Algonquin, Ill.

[73] Assignee: ZMC, Inc., Addison, Ill.

[ * ] Notice: This patent is subject to a terminal disclaimer.

[21] Appl. No.: 08/949,535

[22] Filed: Oct. 14, 1997

[51] Int. Cl.[6] ..... E04D 13/15

[52] U.S. Cl. ..... 52/94; 52/96; 52/715; 52/11

[58] Field of Search ..... 52/11, 94–96, 52/718.01, 208, 573.1, 287.1, 288.11, 58, 698, 712, 715; D25/125, 119; 248/48.1, 48.2; 428/595, 596, 603

[56] References Cited

U.S. PATENT DOCUMENTS

| | | | |
|---|---|---|---|
| D. 396,117 | 7/1998 | Zaccagni | D25/125 |
| 4,461,128 | 7/1984 | Knoebl | 52/94 |
| 4,580,374 | 4/1986 | Quinnell | 52/95 |
| 4,966,819 | 10/1990 | Schatz et al. | 428/603 |
| 5,072,552 | 12/1991 | Sauder | 52/58 |
| 5,581,959 | 12/1996 | Occhipinti | 52/58 |
| 5,735,084 | 4/1998 | Zaccagni | 52/11 |

*Primary Examiner*—Beth Aubrey
*Attorney, Agent, or Firm*—Rockey, Milnamow & Katz, Ltd.

[57] ABSTRACT

A fascia and soffit member is roll-formed from sheet metal, such as sheet aluminum, so as to have two unitary panels meeting at a juncture. One such panel, a fascia panel, extends vertically and upwardly from the juncture when the member is installed. The other panel, a soffit panel, extends horizontally from the juncture when the member is installed. The soffit panel has a distal portion spaced from the juncture and defining plural, elongate, preferential bending regions, along a selected one of which the distal portion is so as to form a wall flange that extends vertically, either upwardly or downwardly, when said member is installed. Preferably, the distal portion has a series of spaced ridges defining a series of spaced grooves, each ridge defining one of the preferential bending regions and each groove defining another of the preferential bending regions, and the ridges and the grooves collectively have a corrugated profile. In a simplified embodiment, the fascia panel is omitted.

13 Claims, 2 Drawing Sheets

FIG. 1
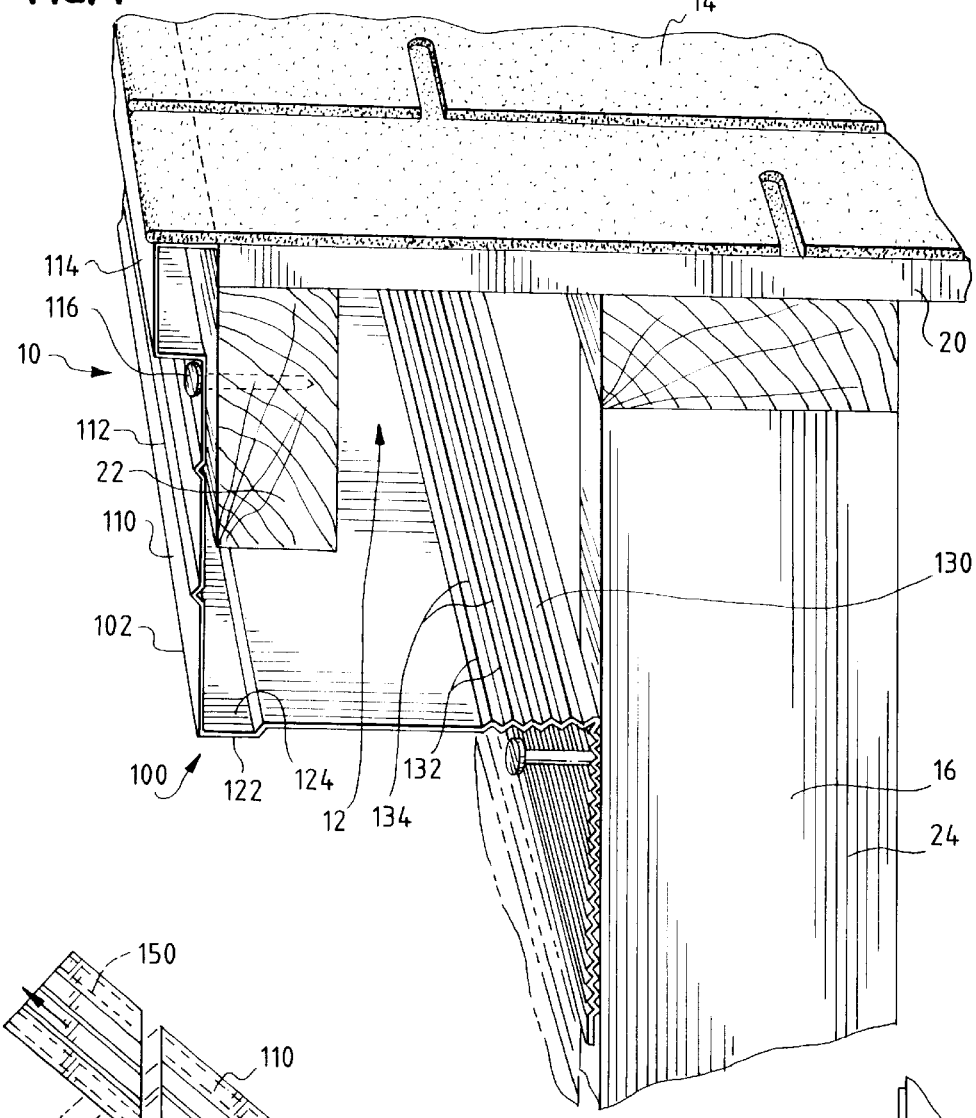
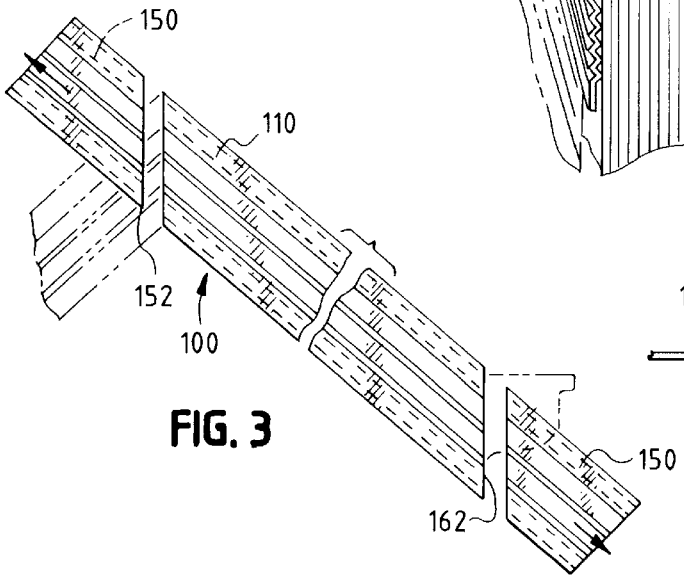
FIG. 3
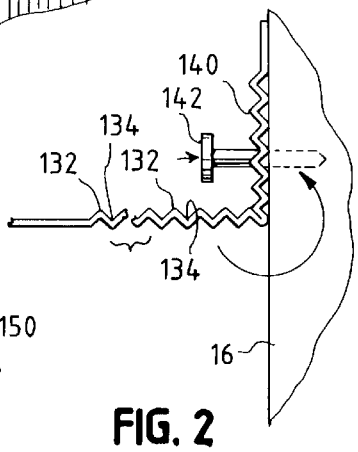
FIG. 2

FIG. 4
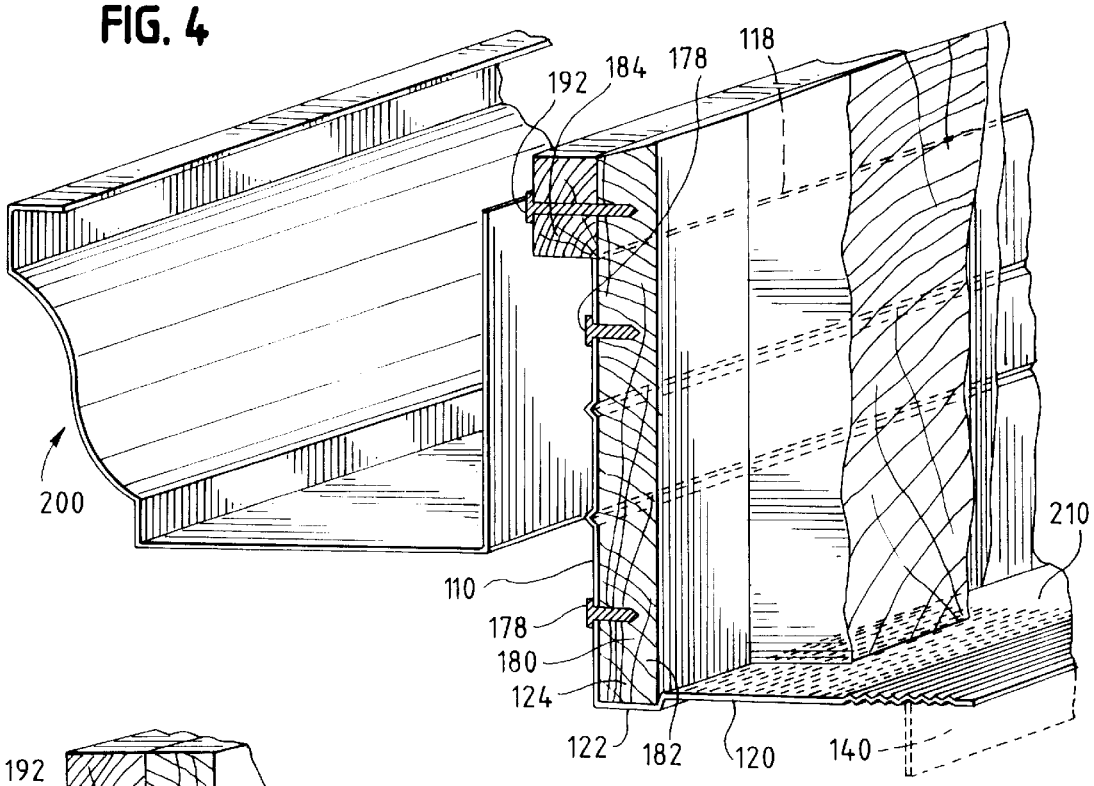
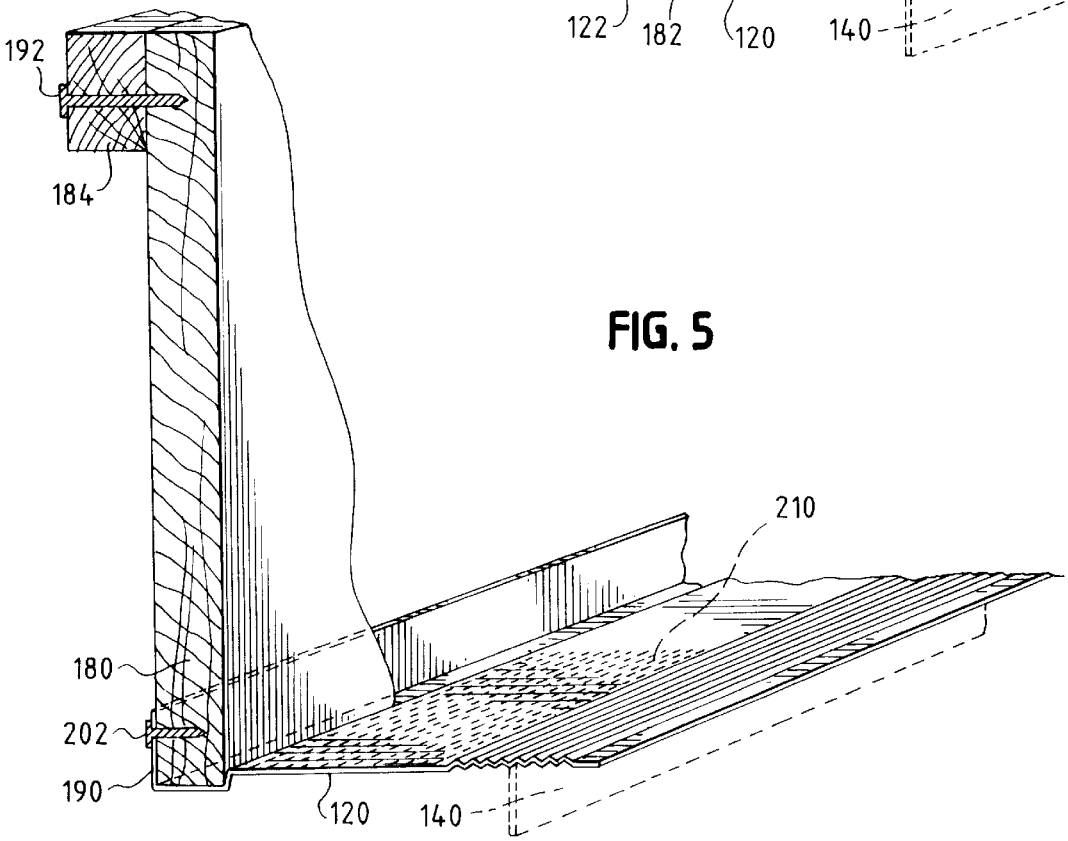
FIG. 5

COMBINED FASCIA AND SOFFIT MEMBER ROLL-FORMED FROM SHEET METAL

CROSS-REFERENCE TO RELATED APPLICATION

This application is a continuation-in-part of U.S. Design patent application Ser. No. 29/075,433, which was filed on Aug. 20, 1997, now U.S. Pat. Des. 396,117.

BACKGROUND OF THE INVENTION

This invention pertains generally to materials used in building constructions and particularly to an improved member roll-formed from sheet metal, such as sheet aluminum, and combining two unitary panels meeting at a juncture, namely a fascia panel and a soffit panel. This invention provides that a distal portion of the soffit panel defines plural, elongate, preferential bending regions, such as a series of spaced ridges defining a series of spaced grooves, so as to facilitate bending of the distal portion, along a selected one of said bending regions.

In a building construction, it is known to use a roll-formed member combining a fascia panel and a soffit panel, as under a roofing overhang. Usually, when such a member is installed, it is not necessary to modify the height of the fascia panel, as by cutting or bending. However, as measured from adjacent walls, roofing overhangs may have nonstandard widths. Commonly, therefore, it is necessary to modify the width of the soffit panel at a building site, as by cutting the soffit panel or bending the soffit panel.

If the soffit panel is bent is bent to form a wall flange extending upwardly or downwardly when the member is installed, the flange can be then used for fastening of the soffit panel to an adjacent wall, as with nails, staples, or other fasteners driven through the flange into an adjacent wall. If the flange extends downwardly when the member is installed, the flange may be then covered, as with a siding panel or with a wooden trimming strip.

Heretofore, it has been difficult to bend a soffit panel of such a member along a straight bending line, particularly if hand tools are used. Commonly, therefore, a brake capable of bending long members along their full lengths is used to bend a soffit panel of such a member. For some installations, particularly but not exclusively for small remodeling or repairing installations, it may be very inconvenient for an installer to use such a brake.

BRIEF SUMMARY OF THE INVENTION

This invention provides, in an improved form, a fascia and soffit member roll-formed from sheet metal. The member, which is elongate, has two unitary panels meeting at a juncture extending along the member. One such panel, a fascia panel, is oriented so as to extend vertically and upwardly from the juncture when the member is installed. The other panel, a soffit panel, is oriented so as to extend horizontally from the juncture when said member is installed. The soffit panel has a distal portion spaced from the juncture.

According to this invention, the distal portion of the soffit panel defines plural, elongate, preferential bending regions extending along the distal portion so as to facilitate bending of the distal portion, along a selected one of the bending regions to form a wall flange, at which the soffit panel is fastenable to a building wall. Preferably, the soffit panel has a generally uniform thickness at the preferential bending regions and elsewhere on the soffit panel.

Preferably, the distal portion of the soffit panel has a series of spaced ridges defining a series of spaced grooves, and each ridge extends along the distal portion and has a generally V-shaped profile defining one of the preferential bending regions and each groove extending along the distal portion. Preferably, moreover, each groove has a similar but inverted profile defining another of the preferential bending regions. Preferably, furthermore, the ridges and the grooves collectively have a corrugated profile.

Before the member is installed, the distal portion of the soffit panel is bent along a selected one of the preferential bending regions so as to form a wall flange, which may be then oriented so as to extend vertically when the member is installed. Preferably, the flange is oriented so as to extend downwardly when the member is installed. Alternatively, the flange is oriented so as to extend upwardly when the member is installed.

In a simplified embodiment of this invention, the fascia panel is omitted so as to provide only the soffit panel having a portion defining plural, elongate, preferential bending regions extending along the soffit panel so as to facilitate bending of the soffit panel, along a selected one of said bending regions to form a wall flange, at which the soffit panel is fastenable to a building wall. In another simplified embodiment of this invention, the fascia panel is replaced with a fascia flange, at which the soffit panel is fastenable to a separate fascia.

These and other objects, features, and advantages of this invention are evident from the following description of a preferred embodiment and an alternative embodiment with reference to the accompanying drawings.

BRIEF DESCRIPTION OF THE SEVERAL VIEWS OF THE DRAWING

FIG. 1 is a fragmentary, perspective view of a building construction comprising a roofing overhang, a shingled roof covering the roofing overhang, and an adjacent wall, as combined with a fascia and soffit member according to the preferred embodiment of this invention.

FIG. 2, on a larger scale compared to FIG. 1, is a fragmentary profile of a fascia and soffit member according to an alternative embodiment of this invention, along with a nail being used to nail the soffit panel of the member to an adjacent wall shown fragmentarily.

FIG. 3, on a smaller scale compared to FIG. 1, is an elevational view taken from the left side of FIG. 1, showing the fascia and soffit member and mitered pieces removed from each end, in full lines, and showing an adjacent gutter, in broken lines.

FIGS. 4 and 5 are fragmentary, perspective views of two alternative embodiments of this invention, along with associated building elements.

DETAILED DESCRIPTION OF THE INVENTION

As shown in FIG. 1, a building construction 10 shown fragmentarily comprises a roofing overhang 12, a shingled roof 14 covering the roofing overhang 12, and an adjacent wall 16, as combined with a fascia and soffit member 100 according to the preferred embodiment of this invention.

As shown in FIG. 1, the roofing overhang 12 comprises a wooden underlayment 20 underlying the shingled roof 14 and a wooden nailing member 22 depending from a distal portion 24 of the wooden underlayment 20, and the adjacent wall 16 comprises a wooden framing member 24. The roofing overhang 12, the shingled roof 14, and the adjacent wall 16 may be wholly conventional structures, details of which are outside the scope of this invention.

Except that certain relative proportions are modified in the accompanying drawings for clarity of illustration, the fascia and soffit member 100 conforms to the combined fascia and soffit member illustrated and described in a copending design patent application filed on Aug. 20, 1997, by Richard J. Zaccagni, under Ser. No. 29/75,433, now U.S. Pat. Des. 396,117, entitled COMBINED FASCIA AND SOFFIT MEMBER, and assigned commonly herewith, the disclosure of which copending application is incorporated herein by reference.

The fascia and soffit member 100 is roll-formed from sheet metal, such as sheet aluminum, which may be prepainted. The fascia and soffit member 100 is roll-formed so as to have two unitary panels meeting at a juncture 102 extending along the member 100, namely a fascia panel 110 and a soffit panel 120. The fascia panel 110 is oriented so as to extend upwardly from the juncture 102, toward the roofing overhang 12, when the member 100 is installed in the building construction 10. The soffit panel 110 is oriented so as to extend horizontally from the juncture 102, toward the adjacent wall 16, when the member 100 is installed in the building construction 10.

The member 100 is roll-formed so as to have two reinforcing ribs 112 extending along the fascia panel 110. The reinforcing ribs 112 are oriented so as to project away from the adjacent wall 16 when the member 100 is installed. The reinforcing ribs 112 may be optionally omitted.

The member 100 is roll-formed so as to form the fascia panel 110 with a distal portion 114, which is offset so as to project away from the adjacent wall 16 when the member 100 is installed, and which is configured to simulate a wooden trimming strip when the member 100 is installed. As shown in FIG. 1, when the member 100 is installed, nails 116 (one shown) are used to nail the fascia panel 110 to the wooden nailing member 22.

The member 100 is roll-formed so as to form the soffit panel 120 with a proximal portion 122, which is adjacent to the juncture 102, which is offset so as to project downwardly when the member 100 is installed, and which is configured to simulate a wooden trimming strip when the member 100 is installed. The offset portion 122 defines a recess 124, which opens upwardly when the member 100 is installed, and which may be also used to accommodate a lower edge of a wooden fascia panel (not shown) that may be optionally installed between the fascia panel 110 and the wooden nailing member 22 so as to project downwardly into the recess 124 defined by the offset portion 122.

The member 100 is roll-formed so as to form the soffit panel 120 with a distal portion 130 having plural, elongate, preferential bending regions, which are defined by a series of spaced ridges 132 defining a series of spaced grooves 134. Each ridge 132 defines one of the preferential bending regions and each groove 134 defines another of the preferential bending regions. The ridges 132 and the grooves 134 collectively have a corrugated profile.

As shown in FIG. 1, formations that project upwardly when the member 100 is installed are regarded as ridges and formations that open upwardly when the member 100 is installed are regarded as grooves, from an upper vantage. However, formations that project downwardly when the member 100 is installed may be alternatively regarded as ridges and formations that open downwardly may be alternatively regarded as grooves, from a lower vantage.

Advantageously, the preferential bending regions defined by the ridges 132 and by the grooves 134 facilitate bending of the distal portion 130 of the soffit panel 110, along a selected one of the bending regions, so as to form a wall flange 140 and so as to provide the soffit panel 120, between the juncture 102 and the flange 140, with a width corresponding to the actual width of the roofing overhang 12. The flange 140 may be then oriented so as to extend vertically when the member 100 is installed.

Preferably, as shown in FIG. 1, the flange 140 is oriented so as to extend downwardly when the member 100 is installed. Alternatively, as shown in FIG. 2, the flange 140 is oriented so as to extend upwardly when the member 100 is installed. In either instance, nails 142 (one shown) are used to nail the flange 140 to the adjacent wall 16.

A hand-held brake or other hand tools can be advantageously used to bend the distal portion 130 of the soffit panel 110, along the selected one of the bending regions, so as to form the flange 140 and so as to provide the soffit panel 120, between the juncture 102 and the flange 140, with a width corresponding to the actual width of the roofing overhang 12. It is not necessary to use a brake capable of bending long members along their full lengths.

As shown in FIG. 3, when the member 100 is installed, end portions 150, 160, are cut from the member 100, along mitered edges 152, 162, so as to fit the member 100 under the roofing overhang 12. A known gutter 170, which is shown in broken lines in FIG. 3, and other known elements (not shown) may be then installed to cover the open ends of the member 100.

Because the member 100 is roll-formed from sheet metal, such as sheet aluminum, the fascia panel 110 can be optionally omitted so as to provide the soffit panel 120 only, either with or without the offset portion 122, in an alternative, simplified embodiment of this invention. If the fascia panel 110 thus is omitted, the soffit panel 120 can be then fastened to the adjacent wall 16 at the flange 140, as described above. Moreover, the soffit panel 120 can be then supported at its opposite edge (where the juncture 102 is shown in FIG. 1) by any known means for supporting a soffit edge spaced from a building wall. As an example, the opposite edge can be then supported in a gutter channel, essentially as disclosed in Zaccagni U.S. Pat. No. 5,537,785, the disclosure of which is incorporated herein by reference.

In the alternative embodiment of FIG. 4, the distal portion 114 of the fascia panel 110 of the preferred embodiment is omitted from the fascia panel 110, which terminates at an upper edge 118. The fascia panel 110 is nailed via nails 184 to a wooden fascia panel 180 having a lower edge 182 accommodated by the recess 124 defined by the offset portion 122 of the soffit panel 120. Instead of the omitted portion 114, a wooden trimming strip 184 is nailed via nails 192 to the wooden fascia panel 180, above the upper edge 118 of the fascia panel 110.

The alternative embodiment of FIG. 5 is similar to the alternative embodiment of FIG. 4, except that the fascia panel 110 is truncated in the alternative embodiment of FIG. 5, so as to define a fascia flange 190, at which the fascia and soffit member 100 is nailed via nails 202 (one shown) to the wooden fascia panel 180.

As shown in broken lines in FIG. 4 and in FIG. 5, the soffit panel 120 is bent downwardly along a selected one of the aforesaid bending regions, so as to form the wall flange 140. As shown in FIG. 4, when the fascia and soffit member 100 is installed horizontally, a conventional gutter 200 may be optionally installed in a conventional manner, over the fascia member 110, below the wooden trimming strip 184.

As shown in FIGS. 4 and 5, the soffit panel 120 of any of the aforementioned embodiments may be optionally provided with multiple ventilating slots 210 or with other ventilating louvers, openings, or slots of any type known heretofore for soffit panels.

Various modifications may be made in the preferred and alternative embodiments described above without departing from the scope and spirit of this invention.

I claim:

1. A fascia and soffit member being elongate and having two unitary panels meeting at a juncture extending along said member, a fascia panel oriented so as to extend vertically and upwardly from the juncture when said member is installed and a soffit panel oriented so as to extend horizontally from the juncture when said member is installed, the soffit panel having a distal portion spaced from the juncture, the distal portion defining plural, elongate, preferential bending regions extending along the distal portion so as to facilitate bending of the distal portion, along a selected one of the bending regions to form a wall flange, which is fastenable to a building wall.

2. The fascia and soffit member of claim 1 wherein the distal portion has a series of spaced ridges defining a series of spaced grooves, each ridge extending along the distal portion and having a generally V-shaped profile defining one of the preferential bending regions and each groove extending along the distal portion.

3. The fascia and soffit member of claim 2 wherein each groove has an inverted profile defining another of the preferential bending regions.

4. The fascia and soffit member of claim 3 wherein said ridges and said grooves collectively have a corrugated profile.

5. The fascia and soffit member of claim 1 wherein the soffit panel has a generally uniform thickness at the preferential bending regions.

6. The fascia and soffit member of claim 5 wherein the distal portion has a series of spaced ridges defining a series of spaced grooves, each ridge having a generally V-shaped profile defining one of the preferential bending regions and each groove having an inverted profile defining another of the preferential bending regions, wherein said ridges and said grooves collectively have a corrugated profile.

7. A fascia and soffit member being elongate and having two unitary panels meeting at a juncture extending along said member, a fascia panel oriented so as to extend vertically and upwardly from the juncture when said member is installed and a soffit panel oriented so as to extend horizontally from the juncture when said member is installed, the soffit panel having a distal portion spaced from the juncture, the distal portion defining plural, elongate, preferential bending regions extending along the distal portion, the distal portion being bent along a selected one of the bending regions to form a wall flange, which is fastenable to a building wall.

8. The fascia and soffit member of claim 7 wherein the distal portion has a series of spaced ridges defining a series of spaced grooves, each ridge having a generally V-shaped profile defining one of the preferential bending regions and each groove having an inverted profile defining another of the preferential bending regions, wherein said ridges and said grooves collectively have a corrugated profile.

9. The fascia and soffit member of claim 7 wherein the wall flange is oriented so as to extend vertically when said member is installed.

10. The fascia and soffit member of claim 7 wherein the wall flange is oriented so as to extend vertically, and so as to be thus parallel to the fascia panel, when said member is installed.

11. The fascia and soffit member of claim 7 wherein the wall flange is oriented so as to extend upwardly, and so as to be thus parallel to the fascia panel, when said member is installed.

12. The fascia and soffit member of claim 7 wherein the wall flange is oriented so as to extend downwardly, and so as to be thus parallel to the fascia panel, when said member is installed.

13. The fascia and soffit member of claim 12 wherein the distal portion has a series of spaced ridges defining a series of spaced grooves, each ridge having a generally V-shaped profile defining one of the preferential bending regions and each groove having an inverted profile defining another of the preferential bending regions, wherein said ridges and said grooves collectively have a corrugated profile.

* * * * *